United States Patent [19]

Ohtani et al.

[11] Patent Number: 5,004,665

[45] Date of Patent: Apr. 2, 1991

[54] TONER CONTAINING POLYMERIC-MAGNETIC COORDINATION COMPLEX

[75] Inventors: Junji Ohtani; Masahiro Anno; Eiichi Sano; Junji Machida; Fumio Masuda, all of Osaka, Japan

[73] Assignee: Minolta Camera Kabushiki Kaisha, Osaka, Japan

[21] Appl. No.: 420,722

[22] Filed: Oct. 11, 1989

Related U.S. Application Data

[63] Continuation of Ser. No. 278,780, Dec. 2, 1988, abandoned.

[30] Foreign Application Priority Data

| | | | |
|---|---|---|---|
| Dec. 2, 1987 | [JP] | Japan | 62-304965 |
| Apr. 28, 1988 | [JP] | Japan | 63-106002 |
| Apr. 28, 1988 | [JP] | Japan | 63-106003 |
| Apr. 28, 1988 | [JP] | Japan | 63-106004 |

[51] Int. Cl.[5] ..... G03G 9/08

[52] U.S. Cl. ..... 430/106.6; 430/110; 430/111; 430/903

[58] Field of Search ..... 430/106.6, 110, 111, 430/903

[56] References Cited

U.S. PATENT DOCUMENTS

| | | | |
|---|---|---|---|
| 4,189,390 | 2/1980 | Noguchi et al. | 430/111 |
| 4,621,039 | 11/1986 | Ciccarolli et al. | 430/110 X |
| 4,623,606 | 11/1986 | Ciccarelli | 430/110 |
| 4,861,693 | 8/1989 | Ohtani et al. | 430/106.6 |

FOREIGN PATENT DOCUMENTS

| | | | |
|---|---|---|---|
| 60-107038 | 6/1985 | Japan | 430/106.6 |

*Primary Examiner*—Roland Martin

*Attorney, Agent, or Firm*—Burns, Doane, Swecker & Mathis

[57] ABSTRACT

According to the present invention, the incorporation of polymeric-magnetic coordination complex powder in a toner effects improvements of chargeability, dusting resistance and fixing properties, and the formation of clear color images.

9 Claims, No Drawings

TONER CONTAINING POLYMERIC-MAGNETIC COORDINATION COMPLEX

This application is a continuation of application Ser. No. 278,780, filed Dec. 2, 1988, now abandoned.

BACKGROUND OF THE INVENTION

The present invention relates to a toner used for electrophotographic reproduction.

In electrophotographic reproduction, the electrostatic latent images may be developed by a developer to visualize. Nowadays, among processes for development, magnetic brush development is mainly employed. The developers used in this method include those of two-component system using toner and carrier containing magnetic powder or those of single-component system wherein toner contains magnetic powder. In magnetic brush method, toner is charged by, for example, triboelectrification and introduced into development zone utilizing magnetic force which the magnetic powder is received, and after development of the electrostatic latent images, transfer and fixing of toner, duplicated images are formed.

Dustability is one of the basic properties to estimate toner. A toner having great dustability is accompanied with several problems such as generation of fog. defective picture quality, unstable density of image, contamination of the inside of a copying machine with toner.

The dusting of toner may occur because the toner has widely distributing charge and the low-charged components thereof, which are not constrained by electrostatic attractive force of carrier on a sleeve, may scatter.

Recently, as a toner for electrostatic development, high definition in line-duplicability, high picture quality in texture, dot duplicability, gradation, resolving power and the like have been required. In order to attain such objects, toner particles are required to be minimized. Such minimization of toner particles, however, provides unfavorable side effect, for example, deterioration of electrification owing to reduction of surface area of toner, deterioration of fluidity of developer or toner itself and the like, and remarkable increase of dusting.

To avoid dusting of toner, a method is proposed wherein magnetic field formed by a magnet roller placed between sleeve and photosensitive member is utilized to constrain toner by its magnetic force. For this purpose, toner containing inorganic magnetic powder is effectively used as toner for two-component system developer.

As such inorganic magnetic material, metal such as iron, cobalt, nickel, alloy of the above metal with other one, or metallic oxide are well known and utilized. When toner is prepared by adding such inorganic magnetic material, the dusting of toner can not be effectively avoided because it is difficult to disperse and incorporate such inorganic magnetic material in binding resin.

Moreover, a spherical toner has such a trouble that it is liable to fly although charged to a high level, because of its small contact with charge giving members such as a carrier or a sleeve).

When color toner is prepared by adding such inorganic magnetic material, it is difficult to effectively enjoy the color of the pigment contained in toner. Especially, when used as transparent color toner, the use of inorganic magnetic powder is accompanied with significant adverse effect.

That is, inorganic magnetic powder itself does not have transparency. Further, it is difficult to uniformly disperse and incorporate inorganic magnetic powder in binding resin, resulting in muddiness as well as marked deterioration of transparency.

Further, toner containing inorganic magnetic powder has a drawback in that it is poorly fixed on a transfer material and the image possesses less smoothness and low density because there remains magnetic material which may not be fused in the fixing step. When the amount of inorganic magnetic powder contained therein is more, such drawback will become more obvious.

Moreover, although such inorganic magnetic materials have such advantages that they are excellent in magnetic properties and stable, they are basically heavy, hard and inferior in processability.

SUMMARY OF THE INVENTION

The present invention is aimed at providing toner which solves the above problems and is free from generation of fog, bad picture quality, unstable image density, dusting which results in contamination of the inside of a copying machine, and provides good fixing and vivid color images.

DETAILED DESCRIPTION OF THE INVENTION

In the present invention, the above object can be attained by incorporating polymeric-magnetic coordination complex powder in toner.

Polymeric-magnetic coordination complex in the invention is polymeric coordination complexes having ferromagnetic properties.

As the polymeric-magnetic coordination complex, for example, known materials such as poly-bis-(2,6-pyridinediylmethylidenenitrilohexamethylenenitrilomethylidene) iron sulfate (hereinafter referred to as "PPH.$FeSO_4$"), polycarbene and the like can be used. Particularly, PPH.$FeSO_4$ is preferred.

PPH.$FeSO_4$ may be easily obtained by dehydration condensation of 2,6-pyridinecarbaldehyde and 1,6-hexanediamine, and reacting with $FeSO_4.7H_2O$ (see, for example, F. Lions and K. V. Martine: J. Am. Chem. Soc., 79, 2733 (1957) or T. Sugano, M. Kinoshita, I. Shirotani and K. Ohno: Solid State Comm., 45, 99 (1983) and the like). As the magnetic properties of such polymeric-magnetic coordination complex, i.e., PPH.$FeSO_4$, is as follows: (applied magnetic field : 1,000 Oe) magnetic flux density (Bm) : about 42 G, magnetization ($\sigma$) : about 3.5 emu/g, residual magnetization : about 7.1 G.

By incorporating polymeric coordination complex, toner having less color muddiness and excellent in dispersibility in a binding resin may be obtained, compared with the case wherein inorganic magnetic material is incorporated. Further, toner free from dusting and excellent in fixing ability may be obtained because magnetism can be imparted to the toner.

The polymeric-magnetic coordination complex powder contained is 0.1–50 wt%, preferably 1–30 wt% to toner. If it is less than 0.1 wt%, marked effect may not be observed. When it is more than 50 wt%, the fixing of the toner may become poor and restraint of the magnet roller may be stronger, resulting in poor developing properties.

In the present invention, it is advantageous to incorporate polymeric-magnetic coordination complex powder in such way that it mostly presents in or on the surface part of the toner.

The incorporation of polymeric-magnetic coordination polymer may be applied more effectively to a spherical toner because a spherical toner is liable to fly although charged to a high level on account of its small contact with charge giving members such as a carrier or a sleeve. A spherical toner can be expressed by shape coefficients SF1 and SF2 which specify a shape of, for example, particles.

SF1 means the difference between the long diameter and short diameter of toner, that is, distortability and defined as;

$$SF1 = \frac{(\text{maximum length})^2}{(\text{area})} \times \frac{(\pi)}{4} \times 100$$

wherein "area" means the projected area of toner and "maximum length" means the longest length in the projected image of toner.

SF1 shows the external surface area of particle and the degree of roughness of a particle surface. The value of SF1 becomes near to the value of 100 as the shape is closer to a circle.

SF2 means the toner surface area (irregularity) and refined as $$SF2 = \frac{(\text{circumference length})^2}{(\text{area})} \times \frac{(\pi)}{4} \times 100$$

wherein "area" means the projected area of toner and "circumference length" means the circumference length of the projected area of toner.

If toner is completely spherical, both SF1 and SF2 are 100. Spherical toners in the invention means that SF1is within the range between 100 and 130 and that SF2 is within the range between 100 and 140.

The shape coefficients SF1 and SF2 in the invention are expressed by mean value measured with above Image Analyzer (LUZEX 5000, made by Nihon Regulator K.K.), but, the value is limited to the one measured by the above Image Analyzer, because the value does not depend generally on a kind of measuring apparatus.

A toner of the invention comprises at least polymeric-magnetic coordination complex, colorant and binding resin.

The binding resin used in the present invention includes, for example, a copolymer of acrylic resin containing a polar group such as carboxyl, hydroxyl, glycidyl, amino, for example, acrylic acid monomer such as methacrylic acid, acrylic acid, maleic acid, itaconic acid; monomer containing hydroxyl group such as hydroxypolypropylene monomethacrylate, polyethylene glycol monomethacrylate; monomer containing amino group such as dimethylaminoethyl methacrylate; glycidyl methacrylate with acrylic acid lower alkyl ester and/or styrene.

Further, thermoplastic resin, for example, polyester resin, e.g., polyester resin obtained by condensation of polyol such as ethylene glycol, triethylene glycol, 1,2-propylene glycol, 1,4-butanediol with dicarboxylic acid such as maleic acid, itaconic acid, malonic acid, and epoxy resin are included. These resins may be subjected to three-dimensional cross-linking to adjust viscosity.

In addition to the above resins, vinyl resin, rosin-modified phenol-formalin resin, cellulose resin, polyether resin, silicone resin, fluorine-contained resin and the like are included.

The colorant contained in the toner of the present invention includes, a red pigment: red iron oxide, cadmium red, red lead oxide, cadmium, mercury sulfide, permanent red 4R, lithol red, pyrazolone red, watchung red, calcium salt, lake red D, brilliant carmine 6B, eosine lake, rhodamine lake B, alizalin lake, brilliant carmine 3B or the like; a green pigment: chrome green, chrome oxide green, pigment green B, malachite green lake, fanal yellow green G or the like; a blue pigment: prussian blue, cobalt blue, alkali blue lake, victoria blue lake, phthalocyanine blue, metal-free phthalocyanine blue, phthalocyanine blue partical chlorine compound, fast sky blue, indanthrene blue BC or the like; a magenta pigment: maganese violet, fast violet B, methyl violet lake or the like; a yellow pigment: chrome yellow, zinc yellow, cadmium yellow, yellow oxide, mineral fast yellow, nickel titanium yellow, nables yellow, naphthol yellow S, hansa yellow G, hansa yellow 10G, benzidine yellow G, benzidine yellow GR, quinoline yellow lake, permanent yellow, NCG, tartrazine lake or the likel; an orange pigment: chrome orange, molybdenum orange, permanent orange GTR, pyrazolone orange, vulcan orange, indanthrene brilliant orange RK, benzidine orange G, indanthrene brilliant orange GK or the like; a black pigment: carbon black, acetylene black, lamp black, aniline black or the like.

The suitable amount of the pigment used is 1–20 wt%, more preferably, 3–7 wt% of the total amount of the toner.

To the toner of the present invention, other additives, for example, a charge controller, an offset inhibitor, and the like may be added.

An typical example of the charge controller which can give the toner positive charge includes, for example, basic dye such as nigrosine oil color, crystal violet and the like, and an typical example of charge controller which can give the toner negative charges includes metal complex dye such as balatin dye, orazole dye and the like.

Such dye may be used alone utilizing its function as colorant as well as charge-controlling ability. Of course, it may be used in combination with the above pigments.

The suitable amount of the charge controller used is 1–20 wt%, more preferably, 3–7 wt% of the total amount of the toner.

The offset inhibitor may be used for enhancement of the fixing properties of the toner of the present invention. Such offset inhibitor includes, for example, wax, low molecular weight polypropylene, polyethylene.

As the toner, those produced by the conventionally known processes, for example, pulverization process which comprises mixing and kneading a thermoplastic binding resin, a colorant and/or a charge generating agent followed by pulverization and classification, or suspension polymerization process which comprises dispersing a colorant and/or a charge generating agent in monomer and polymerizing the resultant, or encapsulation process wherein, for example, liquid containing a colorant and a compound with low softening point such as wax or resin for fixing is enclosed in wall material (capsule sheath) may be used. The toner of an average particle diameter of 2–20 μm may be used without particular limitation so long as it may contains or fix the polymeric-magnetic coordination complex. Even the toner of the present invention may scatter, if it is smaller than 2 μm. If it is larger than 20 μm, the picture quality may be rough.

The types and amount of the thermoplastic resin, compound with low softening point such as wax or resin for fixing and various additives such as a colorant, a chrage generating agent, an offset inhibitor and the like used in the above process for production of toner may be determined according to the conventional techniques.

To incorporate the above polymeric-magnetic coordination complex powder in the toner surface layer, the following processes may be employed:

(a) a process wherein the polymeric-magnetic coordination complex is electrostatically bonded onto the surface of toner and the surface is subjected to fixing treatment by locally applying heat to fix the complex on the toner surface; or (b) a process wherein a resin dispersion or solution of the polymeric-magnetic coordination complex powder and solvent soluble thermoplastic resin and the like is sprayed and dried to form coat on the toner surface.

An example employing the above process (a) will be explained.

In the process for bonding a polymeric-magnetic coordination complex on the surface of toner, for example, the toner and the polymeric-magnetic coordination complex powder are put in a tank equipped with a rotor such as the conventional Henschel mixer, super mixer, and frictionally electrified by rotating the rotor, thereby covering the toner with the polymeric-magnetic coordination complex powder. However, the present invention may not be particularly limited to this process.

Subsequently, the surface layer of the toner covered with the polymeric-magnetic coordination complex powder is locally heated to fix the powder on the surface. The method for local heating includes, for example, a process wherein the material is put in a device such as an instantaneous heating system described in Japanese Patent Laid Open Publication No. 117258/1985, Hybridizer (made by Nara Kikai Seisakusho K.K.), Ang-mill (made by Hosokawa Micron K.K.), Henschel mixer, and stirred to promote heat generation of the surface, a process wherein microwave is used for heating and the like. Thus, various devices may be employed. However, any process may be employed independent of the method, device, means.

The amount of the polymeric-magnetic coordination complex powder to be bonded on the surface of the toner should be suitably selected depending on the types of the toner and the like. However, it is 0.1–20 parts by weight, preferably, 0.5–10 parts by weight per 100 parts by weight of the toner. When it is less than 0.1 parts by weight, the improvement of dusting, which is one object of the present invention, may not be attained. On the other hand, when it is more than 20 parts by weight, the residual polymeric-magnetic coordination complex which can not be bonded to the surface of the toner may deteriorate the properties such as charging properties.

An example employing the above process (b) will be explained.

As the solvent-soluble resin, known resins, for example, styrene-acryl copolymer resin, polystyrene, polyacrylate, polymethacrylate, polyester, epoxy, polyether, polycarbonate, polyacid anhydride, polyolefin such as polyethylene or polypropylene, polyamide or the like may be used.

The amount of the polymeric-magnetic coordination complex powder used is 0.1–20 wt%, preferably, 0.5–10 wt% based on the thermoplastic resin.

In the process (b), the resin dispersion or solution of the polymeric-magnetic coordination complex powder and the solvent-soluble thermoplastic resin and the like is spray-dried on the surface of the toner to form coat resin layer on the surface.

As the method for spray drying, known processes may be applied to form resin layer with the thickness (1/5 or less, preferably ⅛ or less of the average particle diameter of the toner). Technically, it is difficult to form resin layer thicker than 1/5 of an average particle diameter in one step.

Further, various additives such as a colorant, a charge controller, an offset inhibitor and the like may be added to the resin layer as needed.

When the toner of the present invention is used as a one-component magnetic toner, inorganic magnetic materials as well as polymeric-magnetic coordination complex may be incorporated.

Such inorganic magnetic materials include, for example, metal such as iron, nickel, cobalt and the like, an alloy or a mixture of these metals and other metals such as zinc, antimony, aluminum, lead, tin, bismuth, beryllium, manganese, selenium, tungsten, zirconium, vanadium and the like, metallic oxide such as iron oxide, titanium oxide, magnesium oxide and the like, nitride such as chromium nitride, vanadium nitride and the like, a mixture with carbide such as silicon carbide, tungsten carbide and the like and ferromagnetic ferrite, and a mixture thereof.

The amount used is up to 50 parts by weight per 100 parts by weight of the binding resin. When it is more than 50 parts by weight, the fixing properties of the toner may be deteriorated and restraint of magnet roller may be increased, resulting in deterioration of development.

When the toner of the present invention is compounded with a suitable magnetic carrier and used in a mode of a two-component developer, such magnetic carrier includes, for example, metal such as iron, nickel, cobalt and the like, an alloy or a mixture of these metals with other metals such as zinc, antimony, aluminum, lead, tin, bismuth, beryllium, manganese, selenium, tungsten, zirconim, vanadium and the like, metallic oxide such as iron oxide, titanium oxide, magnesium oxide and the like, nitride such as chromium nitride, vanadium nitride and the like, a mixture with carbide such as silicon carbide, tungsten carbide and the like and ferromagnetic ferrite, and a mixture thereof. These carriers may be used in various modes, for example, as binder-type (micro) carrier, magnetic particle-coated carrier, resin particle-coated carrier and the like.

An average particle diameter is 20–100 μm, preferably, 30–80 μm. When the average particle diameter is less than 20 μm, the carrier may readily adhere to the electrostatic latent image carrier, and it is difficult to control the charge amount. When the average particle diameter is over 100 μm, clear image may not be obtained and the picture quality may be deteriorated.

As the composition of the developer, 5–25 wt% toner may be used. When it is more than 25 wt%, charge of toner may be decreased and fog may be generated. When it is less than 5 wt%, charge of the toner may increase to lower the density of the image.

A fluidizing agent may be added and mixed with the toner in order to improve the fluidity. Such fluidizing agent includes, for example, silica, aluminum oxide, titanium oxide, silica-aluminum oxide mixture, silica-titanium oxide mixture.

Preparation of polymeric-magnetic coordination complex PPH.FeSo4

Equimolar 2,6-pyridinedicarbaldehyde and 1,6-hexanediamine were dehydrated and condensed in hot ethanol to give ligand [$C_{13}H_{17}N_3$ $_n$ (white powder, Tm-140° C., hereinafter referred to as PPH). Subsequently, the resulting PPH was allowed to react with $FeSo_4.7H_2O$ under nitrogen flow in hot water at 80°-90 ° C. to give dark red solid. The resulting material was dried in a vacuum desiccator for 72 hours to give the objective polymeric-magnetic coordination complex.

The product was identified according to elemental analysis, infrared spectra, far infrared spectra.

elemental analysis Calcd (%) : C, 45.21; N, 12.17; Fe, 8.09. Found (%) : C, 43.95; N, 12.05; Fe, 7.98.

The elemental analysis was calculated from the empirical formula of $((Fe(C_{13}H_{17}N_3)_2SO_4.6H_2O)_n$. As the molecular weight of PPH-$FeSO_4$is 689.9n, the content of each element (%) is calculated from the following formula;

$$\text{Calc.}(\%)=(A)\times(N)/(689.9)\times 100$$

wherein A represents the atomic weight of an element and N represents the number of the element per one molecule of PPH-$FeSO_4$.

Preparation of Toner 1

Negative-chargeable Toner (Toner A)

| Ingredients | Parts by Weight |
|---|---|
| polyester resin (a softening point: 130° C., a glass transition point: 60° C.) | 262 |
| carbon black (made by Mitsubishi Kasei K.K., MA#8) | 5 |
| polymeric-magnetic coordination complex PPH—$SO_4$ | 10 |

The above ingredients were mixed sufficiently in a ball mill, and kneaded over a three-roll heated to 140° C. The kneaded mixture was left to stand for cooling the same, and then, was coarsely pulverized with the use of a feather mill. The obtained coarse particles were further pulverized by a jet mill, followed by being air-classified to obtain impalpable powder of an average particle diameter of 13 μm (toner A).

Preparation of Toner 2

Positive-chargeable Toner (Toner B)

Toner B was prepared in the same manner as that of the preparation of toner 1 according to the following composition.

| Ingredients | Parts by weight |
|---|---|
| Styrene-n-butyl methacrylate resin (a softening point: 132° C.; a glass transition point: 60° C.) | 100 |
| carbon black (made by Mitsubishi Kasei K.K., MA#8) | 5 |
| Nigrosine dye (made by Oriento Kagaku K.K., Bontron N-01) | 3 |
| polymeric-magnetic coordination complex PPH—$FeSo_4$ | 10 |

-continued

Preparation of Carrier 1 (Binder type)

| Ingredients | parts by weight |
|---|---|
| polyester resin (a softening point: 123° C., a glass transition point: 65° C., AV: 23, OHV: 40) | 100 |
| inorganic magnetic powder (made by Toda Kogyo K.K., EPT-1000) | 500 |
| carbon black (made by Mitsubishi Kasei K.K., MA#8) | 2 |

The above ingredients were mixed sufficiently in a Henschel mixer, pulverized and fused and kneaded using an extrusion kneader wherein the temperature of cylinder and cylinder head was set to 180° C. and 170° C., respectively. The kneaded mixture was cooled, then pulverized in a jet mill, then classified using a classifier to obtain magnetic carrier of an average particle diameter of 55 μm.

Preparation of Carrier 2 (magnetic particle)

2 % Solution of bisphenol type polyester resin (a softening point : 123° C., a glass transition point : 65° C., AV : 21) in toluene was prepared, then, a core material, Ferrite F-250HR (an average particle diameter : 50 μm, electrical resistance : 3.50×1070cm; made by Nihon Teppun K.K.) (3000 parts by weight) was treated with a Spiller coater SP-40 (made by Okada Seiko K.K.) for 120 minutes (spray pressure: 3.5 kg/cm, sprayed amount: 40 g/min., temperature: 50 ° C.), and the aggregates were removed from the resulting particles using a screen (screen opening : 105 μm) to obtain coat carrier (a).

The carrier particle, which was obtained by treating the above coat carrier (a) (400 parts by weight) and Fe-Zn type ferrite MFP-2 dust (electrical resistance : $5.21\times10^8$ Ωcm, made by TDK K.K.) (4 parts by weight) in an ang-mill AM-20F (made by Hosokawa Micron K.K.) (speed of revolution : 1,000 rpm) for 40 minutes, was screened (screen opening : 105 μm) to remove aggregates. Thus, carrier was obtained.

Preparation of Carrier 3

Bisphenol type polyester resin (a softening point : 123 ° C., a glass transition point : 65 ° C., AV : 21, OHV : 43, Mn : 7,600, Mw : 188,400) was pulverized in a jet mill, and then, classified in a pneumatic classifier to obtain polymer particles of an average particle diameter of 2.8 μm.

Subsequently, iron powder TEFV 250/400 (made by Nihon Teppun K.K., an average particle diameter 50 μm, electrical resistance : $3.2\times10^6$Ωcm, true specific gravity : 7.6)(1,000 parts by weight) and the above polymer particles (3 parts by weight) were mixed using Multi-blender Mill (made by Nihon Seiki Seisakusho K.K.) at 10,000 rpm for 5 minutes, and then put in Autoclave TAS-1 (made by Taiatsu Glass Kogyo K.K.) and stirred at 200° C. under nitrogen pressure (30 Kg/$cm^2$) for 3 hours (700 rpm). The aggregate was removed from the obtained particles using a screen (opening : 105

μm) to give coat carrier (an average particle diameter : 54.1 μm, electrical resistance : $3.66\times10^{13}\Omega$cm).

EXAMPLE 1

The toner obtained in the preparation of toner 1 and the carrier obtained in the preparation of carrier 1 were combined to give a developer (mixing ratio of toner : 10 wt%).

The charge of toner after mixing the developer for 3, 10 or 30 minutes was −14.2, −14.1 or −14.1 μC/g, respectively. The results show that charge was instantly built up and stable.

The charge of the toner after storing this developer at 35° C. at high humidity of 85 % RH for 24 hours was −14.3 μC/g. This result indicates that this toner is excellent in resistance to environment.

Subsequently, using this developer and a copy machine equipped with positive-chargeable Se photosensitive member and Teflon-coated, heat-fixing roller, positive electrostatic image was developed by magnetic brush development and 60,000 copies were continuously produced. At the beginning, high definition image excellent in picture quality with uniform density and absolutely free from fog or dusting of toner was obtained. Such high quality was maintained after 60,000 copies were produced. According to the examination of carrier in the developer, the so-called spent of toner was not observed. Further, according to the examination on the photosensitive member, filming was not generated.

The results are shown in Table 1.

In Table 1, general evaluation of the image was indicated using marks; , ◎ , ○, Δ or x, in which, ◎ with proper image density, good fine-line duplicability, free from fog, with gradation duplicability of more than 10.

○: with proper image density, lacking stability of fine-line duplicability, free from fog, with gradation duplicability of more than 8.

Δ: lacking stability of image density, inferior in fine-line duplicability, frequently producing fog, with gradation duplicability of less than 6.

x : with greatly varying image density, deficient in fine-line duplicability, generating fog, with gradation duplicability of less than 4.

As the initial image, the picture quality obtained at the beginning of plate wear test was evaluated, wherein the term "good" means that image of high quality was obtained which had uniform density and was free from fog and dusting of toner and the like.

The picture quality after plate wear test was evaluated. The term "stable" means that image density after printing 60,000 copies was same as that of the initial image.

EXAMPLE 2

In the same manner as that of the Example 1 with the exception that the toner prepared in the preparation of toner 2 and, as a photosensitive member, negative-chargeable laminate-type organic photosensitive member were used, developer was prepared and the toner was evaluated.

The results are shown in Table 1.

EXAMPLE 3

Toner was prepared in the same manner as that of the preparation of toner 2 with the exception that the compounding ratio of the polymeric-magnetic coordination complex powder was 100 parts by weight.

The toner was evaluated in the same manner as that of Example 1, not using carrier but only using toner.

The results are shown in Table 1.

EXAMPLE 4

Toner was prepared and evaluated in the same manner as that of Example 3 with the exception that the compounding ratio of the polymeric-magnetic coordination complex powder was 300 parts by weight.

The results are shown in Table 1.

EXAMPLE 5

Toner was repared and evaluated in the same manner as that of Example 3 with the exception that inorganic magnetic material EPT-1000 (made by Toda Kogyo K.K.) (2 parts by weight) was further added.

The results are shown in Table 1.

EXAMPLE 6

Toner and developer were prepared and evaluated in the same manner as that of Example 1 with the exception that the compounding ratio of the polymeric-magnetic coordination complex was 2 parts by weight and magnetic particle-coated carriers obtained in the preparation of carrier 2 were used.

EXAMPLE 7

Toner and developer were prepared and evaluated in the same manner as that of Example 1 with the exception that the compounding ratio of the polymeric-magnetic coordination complex was 0.5 parts by weight and the resin particle coated carriers obtained in the preparation of carrier 3 were used.

The results are shown in Table 1.

REFERENCE EXAMPLE 1

In the same manner as that of Example 1, developer with a mixing ratio of toner of 10 wt% was obtained. In this example, the toner used was that obtained in the same manner as that of the preparation of toner 1 with the exception that polymeric-magnetic coordination complex was not compounded, and the carrier was that obtained in the preparation of carrier 1.

The charge of the toner after the developer was mixed for 3, 10, 30 minutes was −14.2, −14.3, −14.2 μC/g, respectively.

The charge of the toner after this developer was stored at 35 ° C. under high humidity of 85%RH for 24 hours was 13.8 μC/g.

Using this developer and a copying machine equipped with positive-chargeable Se photosensitive member and teflon-coated heat-fixing roller, positive electrostatic image was developed by magnetic brush development and 60,000 copies were continuously produced.

As the result, fog of toner was slightly observed in back even at the beginning. The developing member was removed and examined As the result, toner was found to adhere to sleeve, which means that toner flied. Further, inside of the copy machine was contaminated with the dusting toner.

The results are shown in Table 1.

REFERENCE EXAMPLE 2

Toner and developer were prepared and evaluated in the same manner as that of Example 1 with the exception that 10 parts by weight of inorganic magnetic material EPT-1000 (made by Toda Kogyo K.K.) was compounded instead of the polymeric-magnetic coordination complex.

REFERENCE EXAMPLE 3

Toner was prepared in the same manner as that of Reference Example 2 with the exception that 50 parts by weight of EPT-1000 was used. The toner was evaluated without using carrier.

The results were shown in Table 1.

REFERENCE EXAMPLE 4

Toner was prepared in the same manner as that of Reference Example 2 with the exception that 10 parts by weight of inorganic magnetic material MFP-2 (made by TDK K.K.) was used, and the toner was evaluated without using carrier.

The results are shown in Table 1.

TABLE 1

| | Toner Polarity | Mixing Time & Toner Charge 3 min. | 10 min. | 30 min. | Charge Under High Humidity | Evaluation *1 | *2 | *3 | *4 | *5 | Comments |
|---|---|---|---|---|---|---|---|---|---|---|---|
| EXAMPLE | | | | | | | | | | | |
| 1 | − | −14.2 | −14.1 | −14.1 | −14.3 | ◎ | 60000 | good | stable | no | *a |
| 2 | + | +15.3 | +15.3 | +15.4 | +15.3 | ◎ | 60000 | good | stable | no | |
| 3 | + | +13.7 | +13.8 | +13.7 | +13.4 | ○ | 60000 | good | stable | — | *b |
| 4 | + | +13.5 | +13.4 | +13.6 | +13.2 | ◎ | 60000 | good | stable | — | *c |
| 5 | + | +13.9 | +13.9 | +14.0 | +13.8 | ◎ | 60000 | good | stable | — | *c |
| 6 | − | −15.1 | −15.0 | −15.0 | −15.2 | ◎ | 60000 | good | stable | no | *a |
| 7 | + | +14.6 | +14.8 | +14.4 | +14.7 | ◎ | 60000 | good | stable | no | *a |
| COMPARATIVE EXAMPLE | | | | | | | | | | | |
| 1 | − | −14.2 | −14.3 | −14.2 | −13.8 | Δ | 60000 | — | — | generation | *d |
| 2 | − | −15.6 | −15.3 | −15.4 | −15.0 | X | 60000 | — | — | generation | *e |
| 3 | + | +15.4 | +15.3 | +15.0 | +14.8 | X | 60000 | — | — | no | *f |
| 4 | + | +14.9 | +14.6 | +14.3 | +14.0 | X | 60000 | — | — | no | *f |

*1: General Evaluation
*2: Plate Wear Test (sheets)
*3: Initial Image
*4: Image Quality
*5: Fog
*a: dusting prevention
*b: sometimes dusting. good fixing properties
*c: good fixing properties
*d: often generation of fogs. a few dusting
*e: bad fixing properties. a few dusting
*f: rough image quality. bad fixing properties

Preparation of Toner 3

Negative-chargeable Toner (Toner C)

| Ingredients | Parts by weight |
|---|---|
| polyester resin (a softening point: 130° C., a glass transition point: 60° C.) | 100 |
| copper phthalocyanine pigment (made by Dainichi Seikakogyo K.K.) | 6 |
| polymeric-magnetic coordination complex PPH—$SO_4$ | 10 |

The above ingredients were mixed sufficiently in a ball mill, and kneaded over a three-roll heated to 140° C. The kneaded mixture was left to stand for cooling the same, and then, was coarsely pulverized with the use of a feather mill. The obtained coarse particles were further pulverized by a jet mill, followed by being air-classified to obtain impalpable powder of an average particle diameter of 13 μm (toner C).

Preparation of Toner 4

Positive-chargeable Toner (Toner D)

Toner D was prepared in the same manner as that of the preparation of toner 3 according to the following composition.

| Ingredients | Parts by weight |
|---|---|
| Styrene-n-butyl methacrylate resin (a softening point: 132° C., a glass transition point: 60° C.) | 100 |
| copper phthalocyanine (made by Dainichi Seikakogyo K.K.) | 6 |
| polymeric-magnetic coordination complex PPH—$SO_4$ | 10 |
| charge controller (made by Arakawa Kagaku K.K., Lunapel 912) | 4 |

Preparation of Toner 5

Negative-chargeable Toner (Toner E)

Toner E was prepared in the same manner as that of the preparation of toner 3 according to the following composition.

| Ingredients | Parts by weight |
|---|---|
| polyester resin (a softening point: 130° C., a glass transition point: 60° C.) | 100 |
| lake red C (made by Dainichi Seikakogyo K.K.) | 5 |
| polymeric-magnetic coordination complex PPH—$FeSO_4$ | 10 |

Preparation of Toner 6

Negative-chargeable Toner (Toner F)

Toner F was prepared in the same manner as that of the preparation of toner 3 according to the following composition.

| Ingredients | Parts by weight |
|---|---|
| polyester resin (a softening point: 130° C., a glass transition point: 60° C.) | 100 |
| Symuller Fast Yellow 5GF (made by Dainippon Ink Kagaku Kogyo K.K.) | 9 |
| polymeric-magnetic coordination complex PPH—$FeSO_4$ | 10 |

EXAMPLE 8

The toner obtained in the preparation of toner 3 and the carrier obtained in the preparation of carrier 1 were combined to give a developer (mixing ratio of toner: 10 wt%).

The charge of the toner after the developer was mixed for 3, 10 or 30 minutes was −11.2, −11.3 or −11.3 μC/g, respectively. The results show that charge was instantly and stably built up.

The charge of the toner after storing this developer at 35° C. at high humidity of 85% RH for 24 hours was −11.0 μC/g. This result indicates that this toner is excellent in resistance to environment.

Subsequently, using this developer and a copy machine equipped with positive-chargeable Se sensitive member and Teflon-coated heat-fixing roller, positive electrostatic image was developed by magnetic brush development and 60,000 copies were continuously produced. At the beginning, high definition image excellent in picture quality with uniform density and absolutely free from fog or dusting of toner was obtained. Such high quality was maintained after 60,000 copies were produced. The toner image was vivid blue and muddiness was not observed. According to the examination of carrier in the developer, the so-called spent of toner was not observed. Further, according to the examination on the photosensitive member, filming was not generated.

The results are shown in Table 2.

In Table 2, general evaluation of the image was indicated using marks; ◎, o, Δ or x, in which, ◎: with proper image density, good fine-line duplicability, free from fog, with gradation duplicability of more than 10.

o: with proper image density, lacking stability of fine-line duplicability, free from fog, with gradation duplicability of more than 8.

Δ: lacking stability of image density, inferior in fine-line duplicability, frequently producing fog, with gradation duplicability of less than 6.

x: with greatly varying image density, deficient in fine-line duplicability, generating fog, with gradation duplicability of less than 4.

As the initial image, the picture quality obtained at the beginning of plate wear test was evaluated, wherein the term "good" means that image of high quality having uniform density and was free from fog and dusting of toner and the like was obtained.

The picture quality after plate wear test was evaluated. The term "stable" means that image density after printing 60,000 copies was same as that of the initial image.

As muddiness, "no" indicates that the toner had vivid color without muddiness.

Fixing was indicated using marks wherein

◎: the image retained its clear appearance after rubbed with an eraser 20 times.

o: the image retained its clear appearance after rubbed with an eraser more than 15 times.

Δ: the image retained its clear appearance after rubbed with an eraser more than 5 times.

x: the image became unclear after rubbed with an eraser 5 times.

EXAMPLE 9

In the same manner as that of the Example 8 with the exception that the toner prepared in the preparation of toner 4 and, as a photosensitive member, negative-chargeable laminate-type organic photosensitive member were used, developer was prepared and the toner was evaluated.

The results are shown in Table 2.

EXAMPLE 10

Toner was prepared in the same manner as that of the preparation of toner 3 with the exception that the compounding ratio of the polymeric-magnetic coordination complex powder was 30 parts by weight. The toner was evaluated in the same manner as that of Example 8 with the exception that the above toner was used.

The results are shown in Table 2.

EXAMPLE 11

Toner was prepared in the same manner as that of the preparation of toner 4 with the exception that the compounding ratio of the polymeric-magnetic coordination complex powder was 30 parts by weight. The evaluation was made in the same manner as that of Example 9 with the exception that the toner was used.

The results are shown in Table 2.

EXAMPLE 12

The evaluation was made in the same manner as that of Example 8 with the exception that the carrier obtained in the preparation of carrier 2 was used.

The results are shown in Table 2.

EXAMPLE 13

The evaluation was made in the same manner as that of Example 9 with the exception that the carrier obtained in the preparation of carrier 3 was used.

The results are shown in Table 2.

EXAMPLE 14

The evaluation was made in the same manner as that of Example 8 with the exception that the toner E obtained in the preparation of toner 5 was used.

The results are shown in Table 2.

EXAMPLE 15

The evaluation was made in the same manner as that of Example 8 with the exception that toner F obtained in the preparation of toner 6 was used.

The results are shown in Table 2.

REFERENCE EXAMPLE 5

In the same manner as that of Example 8, the developer with a mixing ratio of toner of 10 wt% was obtained. In this example, the toner used was that obtained in the same manner as that of the preparation of toner 3 with the exception that polymeric-magnetic coordination complex was not compounded, and the carrier was that obtained in the preparation of carrier 1. The charge of the toner after the developer was mixed for 3, 10, 30 minutes was −12.1, −12.4, −12.5 μC/g, respectively.

The charge of the toner after this developer was stored at 35° C. at high humidity of 85%RH for 24 hours was 11.9 μC/g.

Using this developer and a copying machine equipped with positive-chargeable Se sensitive member and teflon-coated heat fixing roller, positive electrostatic image was developed by magnetic brush development and 60,000 copies were continuously produced.

As the result, fog of toner was remarkably observed and remarkable fog was observed in the image.

The results are shown in Table 2.

REFERENCE EXAMPLE 6

Toner and developer were prepared in the same manner as that of Example 8 with the exception that 10 parts by weight of inorganic magnetic material EPT-1000 (made by Toda Kogyo K.K.) was compounded instead of the polymeric-magnetic coordination complex.

The results are shown in Table 2.

TABLE 2

| | Toner Polarity | Mixing Time & Toner Charge 3 min. | 10 min. | 30 min. | Charge Under High Humidity | Evaluation *1 | *2 | *3 | *4 | *5 | *6 | *7 | *8 |
|---|---|---|---|---|---|---|---|---|---|---|---|---|---|
| EXAMPLE | | | | | | | | | | | | | |
| 8 | − | −11.2 | −11.3 | −11.3 | −11.1 | ◎ | 60000 | good | stable | no | no | no | ◎ |
| 9 | + | +12.0 | +12.2 | +12.2 | +12.1 | ◎ | 60000 | good | stable | no | no | no | ◎ |
| 10 | − | −12.3 | −12.4 | −12.4 | −12.0 | ◎ | 60000 | good | stable | no | no | no | ◎ |
| 11 | + | +13.2 | +13.1 | +13.1 | +13.0 | ◎ | 60000 | good | stable | no | no | no | ◎ |
| 12 | − | −13.8 | −13.7 | −13.8 | −13.6 | ◎ | 60000 | good | stable | no | no | no | ◎ |
| 13 | + | +14.2 | +14.0 | +14.1 | +14.0 | ◎ | 60000 | good | stable | no | no | no | ◎ |
| 14 | − | −10.9 | −11.1 | −11.1 | −11.0 | ◎ | 60000 | good | stable | no | no | no | ◎ |
| 15 | − | −12.1 | −12.0 | −12.1 | −11.9 | ◎ | 60000 | good | stable | no | no | no | ◎ |
| COMPARATIVE EXAMPLE | | | | | | | | | | | | | |
| 5 | − | −14.0 | −14.1 | −14.0 | −13.8 | Δ | 60000 | a little bad | unstable | generation | much | no | |
| 6 | − | −14.6 | −14.4 | −14.4 | −14.0 | X | 60000 | bad | unstable | generation | a few | *a | X |

*1: General Evaluation
*2: Plate Wear Test (sheets)
*3: Initial Image
*4: Image Quality
*5: Fog
*6: Dusting
*7: Color Muddiness
*8: Fixing Properties
*a: black muddiness

Preparation of Toner Core Material

Preparation of Toner Core Material A (for negative-chargeable toner)

| Ingredients | Parts by Weight |
|---|---|
| Polyester resin (a softening point: 130° C., a glass transition point: 60° C.) | 100 |
| carbon black (made by Mitsubishi Kasei K.K., MA#8) | 5 |
| chrome complex salt type dye, spilon black TRH (made by Hodogaya Kagaku Kogyo K.K.) | 3 |

The above ingredients were mixed sufficiently in a ball mill, and kneaded over a three-roll heated to 140° C. The kneaded mixture was left to stand for cooling the same, and then, was pulverized with the use of a feather mill. The obtained coarse particles were further pulverized by a jet mill, followed by being air-classified to obtain impalpable powder of an average particle diameter of 7 μm. The resulting impalpable powder was used as toner core material A.

Preparation of toner core material B (for positive-chargeable toner)

Toner core material B was prepared in the same manner as that of the toner core material according to the following composition.

| Ingredients | Parts by Weight |
|---|---|
| Styrene-n-butyl methacrylate resin (a softening point: 132° C.; a glass transition point: 60° C.) | 100 |
| carbon black (made by Mitsubishi Kasei K.K., MA#8) | 5 |
| Nigrosine dye (made by Oriento Kagaku K.K., Bontron N-01) | 3 |

Preparation of Toner Core Material C

| Ingredients | Parts by Weight |
|---|---|
| styrene | 60 |
| n-butyl methacrylateowder | 35 |
| methacrylic acid | 5 |
| 2,2-azobis-(2,4-dimethylvaleronitrile) | 0.5 |
| low molecular weight oxygen convertible polypropylene (made by Sanyo Kasei Kogyo K.K.; Viscol TS-200) | 3 |
| carbon black (made by Mitsubishi Kasei K.K., MA#8) | 8 |
| chrom complex salt type dye, spilon black TRH (made by Hodogaya Kagaku Kogyo K.K.) | 3 |

The above ingredients were mixed sufficiently in a sand stirrer to prepare polymerizable composition. The resulting polymerizable composition was polymerized at 60° C. for 6 hours while stirring in an aqueous solution of gum arabic (concentration : 3 wt%) in a stirrer ("T. K. Auto-Homomixer", made by Tokushu Kikai Kogyo K.K., speed of revolution : 4,000 rpm). The polymerization was further continued while temperature was raised to 80° C. After the polymerization was over, the reaction system was cooled, washed with water (×6), filtered and dried to obtain globules.

The resulting globules with an average particle diameter of 7 μm, a softening point (Tm) of 141° C. and a glass transition point (Tg) of 61° C. was used as globular toner core material C.

Preparation of Toner Core Material D

In the same manner as Toner core material B with the exception that Nigrosine dye (made by Orient Kagaku Kogyo K.K. : Bontron N-01) was not added, toner core material D of an average particle diameter of 6 μm was obtained.

Preparation of Toner 7

The toner core material A (100 parts by weight) and polymeric-magnetic coordination complex PPH-$FeSO_4$(1 part be weight) were put in 10 L Henschel mixer, and mixed and stirred at revolving speed of 1,500 rpm for 2 minutes to cover the surface of the toner core material A with the polymeric-magnetic coordination complex PPH-$FeSO_4$ dust.

Subsequently, the polymeric-magnetic coordination PPH-$FeSO_4$ dust was stabilized by treatment using a hybridizer (Nara Kikai Hybridization System Type NHS-1, made by Nara Kikai Seisakusho K.K.) at 6,000 rpm for 3 minutes.

Thus obtained product was used as toner a.

An average particle diameter of the toner a was 8 μm.

Preparations of Toner 8 and 9

Toner was prepared in the same manner as that of the preparation of toner 7 with the exception that toner core material B or C was used as toner core particle. The obtained toners were termed as toner b and c.

An average diameter of the toner b and c was 8 μm respectively.

Preparation of Toner 10

After the surface of the toner core material D was treated with the impalpable powder of the polymeric-magnetic coordination complex PPH-$FeSO_4$ using toner core material D in the same manner as that of the preparation of toner 7, the resulting particles (100 parts by weight) and Nigrosine dye (made by Orient Kagaku Kogyo K.K.; Bontron N-01) (0.5 parts by weight) were put in 10 L Henschel mixer, and mixed and stirred at 1,500 rpm for 2 minutes to cover the surface of the particles with Nigrosine dye.

Subsequently, Nigrosine dye was stabilized by treatment using a hybridizer (Nara Kikai Hybridization System Type NHS-1, made by Nara Kikai Seisakusho K.K.) at 6,000 rpm for 3 minutes. The obtained product was used as toner d.

An average particle diameter of the toner d was 7 μm.

Preparation of Toner 11

| | |
|---|---|
| polyethylene wax | 100 parts by weight |
| carbon black (made by Mitsubishi Kasei Kogyo K.K.; MA#8) | 5 parts by weight |

In the same manner as that of the preparation of toner core material A, particles of an average diameter of 7 μm was obtained from the above mixture.

| | |
|---|---|
| styrene-acrylic copolymer resin | 100 parts by weight |

-continued

| | |
|---|---|
| (a softening point (Tm): 135° C., a glass transition point (Tg): 58° C.) | |
| impalpable powder of polymeric coordination complex PPH—$FeSO_4$ | 5 parts by weight |
| Nigrosine dye, Bontron N-01 | 3 parts by weight |

and the resulting dispersion was spray-dried to obtain capsule toner e of an average particle diameter of 8 μm.

Preparation of Toner 12 and 13

The toner core materials A and B were directly used as toners f and g.

Preparation of Toner 14

Toner h was obtained in the same manner as the preparation of toner a with the exception that inorganic magnetic material EPT-1000 (Magnetite, made by Toda Kogyo K.K.) (3 parts by weight) was used instead of the polymeric-magnetic coordination complex. An average particle diameter of the toner h was 8 μm.

Preparation of Toner 15

Using the same composition and manner as those of the preparation of toner core material C with the exception that 1 part by weight of polymeric-magnetic coordination complex PPH-FeSO was added, particles of an average particle diameter of 7 μm was obtained.

Thus obtained product was used as toner i.

EXAMPLE 16

The toner a obtained in the preparation of toner 7 and the carrier obtained in the preparation of carrier 3 were combined to give a developer (mixing ratio of toner : 10 wt%).

The charge and dusting of the toner after the developer was mixed for 3, 10 or 30 minutes were measured.

The charge was −12.8, −12.7 or −12.7 μC/g, and dusting was 22, 23, 21 cpm, respectively. The results show that charge was instantly and stable built up.

The charge and dusting of the toner after storing this developer at 35° C. at high humidity of 85% RH for 24 hours were −11.0 μC/g and 23 cpm, respectively. This result indicates that this toner is excellent in resistance to environment.

The build-up of charge of the toner was examined by putting surface-treated (post-treated with 0.1 parts by weight of colloidal silica (made by Nihon Aerosol K.K.) based on 100 parts by weight of toner) (2 g) and carrier (28 g) in 50 cc plastic bottle which was placed on a rotating frame, rotating the frame at 1,200 rpm, and measuring the charge after stirring for 3, 10 and 30 minutes.

The dustability was measured using a digital dust measuring apparatus type P5H2 (made by Shibata Kagaku K.K.). The above dust measuring apparatus was placed 10 cm away from the magnet roller, and the developer (2 g) was set on the magnet roller. The toner particles produced when the magnet roller was rotated at 2,000 rpm was measured as dust by the above dust measuring apparatus and indicated as count per minute (cpm).

Subsequently, using the above developer and a copy machine equipped with positive-chargeable Se sensitive member and Teflon-coated heat-fixing roller and having an ability to produce 50 copies per minutes (A4 sheets by trans feed), positive electrostatic image was developed by magnetic brush development and 60,000 copies were continuously produced. At the beginning, high definition image excellent in picture quality with uniform density and absolutely free form fog or dusting of toner was obtained. Such high quality was maintained after 60,000 copies were produced. According to the examination of carrier in the developer, the spent of toner was not observed. Further, according to the examination on the photosensitive member, filming was not generated.

The results are shown in Table 3.

In Table 3, general evaluation of the image was indicated using marks; ◎, ○, Δor x, in which, ◎: with proper image density, good fine-line duplicability, free from fog, with gradation duplicability of more than 10.

○: with proper image density, lacking stability of fine-line duplicability, free from fog, with gradation duplicability of more than 8.

Δ: lacking stability of image density, inferior in fine-line duplicability, frequently producing fog, with gradation duplicability of less than 6.

x : with greatly varying image density, deficient in fine-line duplicability, generating fog, with gradation duplicability of less than 4.

As for the initial image in Table 3, the picture quality obtained at the beginning of plate wear test was evaluated, wherein the term "good" means that image of high quality having uniform density and was free from fog and dusting of toner and the like.

The picture quality after plate wear test was evaluated. The term "stable" means that image density after printing 60,000 copies was same as that of the initial image.

Fixing properties was evaluated by rubbing the initial image with an eraser and indicated using marks in which x : the image became unclear after 15 times rubbing.

: the image retained its clear appearance even after 15 times rubbing.

EXAMPLE 17

In the same manner as that of the Example 16 with the exception that the toner b prepared in the preparation of toner 8 and, as a photosensitive member, negative-chargeable laminate-type organic photosensitive member were used, developer was prepared and the toner was evaluated.

The results are shown in Table 3.

EXAMPLE 18

Developer was prepared in the same manner as that of Example 16 with the exception that the toner c prepared in the preparation of toner 9 was used and the toner was evaluated.

The results are shown in Table 3.

EXAMPLE 19

Developer was prepared in the same manner as that of Example 16 with the exception that the toner d prepared in the preparation of toner 10 was used and the toner was evaluated.

The results are shown in Table 3.

EXAMPLE 20

Developer was prepared in the same manner as that of Example 17 with the exception that the toner e prepared in the preparation of toner 11 was used and the toner was evaluated.

The results are shown in Table 3.

REFERENCE EXAMPLE 7

In the same manner as that of Example 16, the developer with a mixing ratio of toner of 10 wt% was obtained. In the example, the toner used was the toner f obtained in the preparation of toner 12.

The charge and dusting of the toner after the developer was mixed for 3, 10, 30 minutes was −13.4, −13.5, −13.6 μC/g; 340, 336, 332 cpm, respectively.

Compared with the data of Example 16, the dusting of the toner of this reference example was much greater, resulting in providing problems such as fog of the image and contamination of the inside of a copying machine.

Using this developer, plate wear test was conducted under the same conditions as those of Example 16. As the result, the charge of toner was unstable and fog of the image was generated even at the beginning.

REFERENCE EXAMPLE 8

The same evaluations as those of Example 17 were made using toner g.

The results are shown in Table 3.

REFERENCE EXAMPLE 9

The same evaluations as those of Example 16 were made using toner h.

The results are shown in Table 3.

REFERENCE EXAMPLE 10

The same evaluation as those of Example 16 were made using toner i.

The results are shown in Table 3.

TABLE 3

| | | 3 min. | | 10 min. | | 30 min. | | After Humidity Resistant Test | | | | | | | |
|---|---|---|---|---|---|---|---|---|---|---|---|---|---|---|---|
| | Toner | toner charge (ηC/g) | dusting charge (cpm) | toner charge (ηC/g) | dusting charge (cpm) | toner charge (ηC/g) | dusting charge (cpm) | toner charge (ηC/g) | dusting charge (cpm) | *1 | *2 | *3 | *4 | *5 | *6 |
| EXAMPLE | | | | | | | | | | | | | | | |
| 16 | a | −12.8 | 22 | −12.7 | 23 | −12.7 | 21 | −12.7 | 23 | ○ | 60000 | good | stable | no | ○ |
| 17 | b | +13.1 | 21 | +13.2 | 20 | +13.2 | 20 | +13.2 | 21 | ○ | 60000 | good | stable | no | ○ |
| 18 | c | −10.6 | 24 | −10.7 | 24 | −10.7 | 23 | −10.6 | 24 | ○ | 60000 | good | stable | no | ○ |
| 19 | d | −13.2 | 20 | −13.3 | 19 | −13.3 | 19 | −13.3 | 19 | ○ | 60000 | good | stable | no | ○ |
| 20 | e | +11.6 | 31 | +11.7 | 30 | +11.8 | 31 | +11.7 | 32 | ○ | 60000 | good | stable | no | ○ |
| COMPARATIVE EXAMPLE | | | | | | | | | | | | | | | |
| 7 | f | −13.4 | 340 | −13.5 | 336 | −13.6 | 332 | −12.9 | 340 | Δ | — | fog | bad | observed | ○ |

TABLE 3-continued

| | Toner | 3 min. toner charge (ηC/g) | 3 min. dusting charge (cpm) | 10 min. toner charge (ηC/g) | 10 min. dusting charge (cpm) | 30 min. toner charge (ηC/g) | 30 min. dusting charge (cpm) | After Humidity Resistant Test toner charge (ηC/g) | After Humidity Resistant Test dusting charge (cpm) | *1 | *2 | *3 | *4 | *5 | *6 |
|---|---|---|---|---|---|---|---|---|---|---|---|---|---|---|---|
| 8 | g | +13.6 | 321 | +13.7 | 326 | +13.6 | 324 | +13.1 | 341 | Δ | — | fog | bad | observed | O |
| 9 | h | −7.6 | 92 | −7.7 | 81 | −7.8 | 78 | −6.1 | 121 | X | — | fog | bad | observed | X |
| 10 | i | −11.0 | 79 | −11.2 | 68 | −11.3 | 60 | −10.9 | 93 | Δ | — | fog | bad | observed | O |

*1: General Evaluation
*2: Plate Wear Test (sheets)
*3: Initial Image
*4: Image Quality
*5: Fog
*6: Fixing Properties

Preparation of Toner 16 and 17

Negative-chargeable Toner (Toner A')

| Ingredients | Parts by Weight |
|---|---|
| polyester resin (a softening point: 130° C., a glass transition point: 60° C.) | 100 |
| carbon black (made by Mitsubishi Kasei K.K., MA#8) | 5 |
| polymeric-magnetic coordination complex PPH—$SO_4$ | 10 |

The above ingredients were mixed sufficiently in a ball mill, and kneaded over a three-roll heated to 140° C. The kneaded mixture was left to stand for cooling the same, and then, was coarsely pulverized with the use of a feather mill. The obtained coarse particles were further pulverized by a jet mill, followed by being air-classified to obtain fine powder of an average particle diameter of 13 μm (toner a').

Positive-chargeable Toner (Toner B')

Toner b' was prepared in the same manner as that of the preparation of toner a' according to the following composition.

| Ingredients | Parts by weight |
|---|---|
| Styrene-n-butyl methacrylate resin (a softening point: 132° C.; a glass transition point: 60° C.) | 100 |
| carbon black (made by Mitsubishi Kasei K.K., MA#8) | 5 |
| Nigrosine dye (made by Oriento Kagaku K.K., Bontron N-01) | 3 |
| polymeric-magnetic coordination complex PPH—$FeSO_4$ | 10 |

Subsequently, toner a' and toner b' were treated for rounding them by use of Hhybridizer( Nara Kikai Hybridization System NHS-1, made by NARA Kikai Seisakusho K.K. at 9000 rpm for 3 minutes. The obtained spherical toners were referred to as toner A' and toner B'. The mean particle sizes of spherical toner A' and B' were 13 μm respectively, being same as those of toner a' and toner b' of pre-rounding treatment.

SF1 of toner A' was 121, and SF2 of toner A' was 137. SF1 of toner B' was 122, and SF2 of toner B' was 135.

Preparation of Toner 18 and 19

Toner C' and toner D' were prepared at same composition and by same method as the preparation of toner A' and B' except that the polymeric magnetic coordination complex was not used.

The mean particle sizes of spherical toner C' and D' were 13 μm respectively. SF1 of toner C' was 124, and SF2 of toner C' was 137. SF1 of toner D' was 123, and SF2 of toner D' was 135.

Preparation of Toner 20

| | parts by weight |
|---|---|
| styrene | 60 |
| n-butyl methacrylate | 35 |
| methacrylic acid | 5 |
| 2,2'-azobis(2,4-dimethylvaleronitrile) | 0.5 |
| low-molecular weight oxidizing type polypropylene [Viscol TS-200 (made by Sanyo Kasei Kogyo K.K.) | 3 |
| Cabon black MA# 8 (made by Mitsubishi Kasei Kogyo K.K.) | 8 |
| Spilon Black TRH (chromium complex-type dye) | 3 |
| polymeric-magnetic coordination complex PPH—$FeSO_4$ | 10 |

The above ingredients were mixed sufficiently with the use of Sand-stirrer to prepare a polymerizable composition. This polymerizable composition was mixed with as aqueous solution of arabic gum of a concentration of 3 % by weight, and they were stirred at 3,000 rpm with the use of T.K. Auto Homo Mixer (made by Tokusyukikai Kogyosya K.K.) to polymerize them at the temperature of 60° C. for 6 hours, they were heated to 80° C. and further polymerized them. After their polymerization, the system of reaction was cooled, rinsed with water 5 times, then filtered and dried, resulting in spherical particles. The obtaied spherical particles were referred to as toner E'. Toner E' was 11 μm in mean particle size, 141 ° C. in softening point(Tg), and 61° C. in glass transition point(Tg). SF1 was 107 and SF2 was 113.

Preparation of Toner 21

Toner F' was prepared at same compositions and by same method as the preparation of toner E' except that the polymeric magnetic coordination complex was not used.

The mean particle size of spherical toner E' was 12 μm.

SF1 of toner F' was 108, and SF2 was 117.

Preparation of Toner 22

| | parts by weight |
|---|---|
| polyethylene wax | 100 |
| Carbon Black MA#8 (Mitsubishi Kasei Kogyo K.K.) | 5 |
| polymeric-magnetic coordination complex PPH—$FeSO_4$ | 10 |

Particle g' of 12 μm in mean particle size was obtained using the above ingredient as similarly as the preparation of toner A'.

| | parts by weight |
|---|---|
| Particle g' | 100 |
| Styrene-acryric copolymer resin (Tm; 135° C., Tg; 58° C.) | 100 |
| Bontron N-01 (Nigrosine type) | 3 |

These ingredients were dispersed sufficiently in 10% methyl ethyl ketone solution. The dispersion solution was applied to toner g' by means of spray drier to prepare encapsulated toner G' of 13 μm in mean particle size.

The resultant toner G' had SF1 of 111 and SF2 of 119.

Preparation of Toner 23

Toner H' was prepared at same compositions and by same method as the preparation of toner G' except that the polymeric magnetic coordination complex was not used.

The mean particle size of spherical toner H' was 13 μm.

SF1 of toner H' was 110, and SF2 was 120.

Preparation of Toner 24

| | parts by weight |
|---|---|
| Styrene (first grade; made by Wako Junyaku Kogyo) | 104 |
| 2-ethylhexylmethacrylate (first grade; made by Wako Junyaku Kogyo) | 198 |
| Azo-bisisobutyro-nitrile (first grade; made by Wako Junyaku Kogyo) | 3.3 |

These ingredients were dissolved in Isoper H (made by Shell Chemical K.K.; aliphatic hydrocarbon) of 300 parts by weight, and the solution was poured into a four knecked flask with a cooler and a stirrer and nitrogen gas was itroduced into the flask for bubbling for 10 minutes and gas inside the flask was replaced with nitrogen. Then, the solution was heated to 75° C., stirred for 6 hours to complete polymerizaition. The synthesized resin was in liquid condition with high viscosity dissolved in Isoper H.

Then, the obtained resin (300 g) for fixing was dissolved in acetone solvent (100 g). The solution was further added with $CuFe_2O_4$-$CuMn_2O_4$ (made by Dainichiseika Kogyo K.K.) of 60 g and polymeric magnetic coordination polymer of 30 g for sufficient dispersion by use of vibration mills.

The particle size distribution of $CuFe_2O_4$-$CuMn_2O_4$ was within the range of 0.05–1 μm by means of a apparatus of light transparent type measuring for particle size distribution, and the mean particle size was within the range of 0.1–0.2 μm. The oil absorption was 35 cc/100g.

The obtained black ink (150 g) was added with a solution of Takenate D-102 (isocyanate; made by Takeda Yakuhin K.K.)(10 g) in ethyl acetate (5 g) under cooling conditions and then stirred sufficiently to prepare black ink-isocyanate solution.

On the other hand, an aqueous solution of 5% arabic gum (made by Wako Junyaku Kogyo K.K.) was prepared and cooled sufficiently in ice water bath. The black ink-isocyanate solution was added into the above aqueous solution, ground finely at 6,000 rpm with the use of Auto Homo Mixer, and subsequently stirred for 30 minutes.

And then, 10% hexamethylene diamine solution (made by Wako Junyaku Kogyo K.K.) of 20 g was dropped into the above solution and stirred for 10 minutes. And then, the solution was heated gradually to the temperature within the range of between 80° C. and 90° C. The temperature was maintained to continue the reaction for 6 hours. After the reaction ended, dehydration treatment, 2–3 times washing treatment with purified water were carried out, then not-reacted materials and arabic gum were wash out with water. The reaction product was dried and classified to obtain spherical encapsulated toner I' of 13 μm in mean particle size.

The toner I' had SF1 of 106, and SF2 of 114.

Preparation of Toner 25

Spherical encapsulated toner J' was prepared at same compositions and by same method as the preparation of toner I' except that the polymeric magnetic coordination complex was not used. The toner was classified so that the mean particle size of the spherical encapsulated toner might be 13 μm.

SF1 of toner J' was 106, and SF2 was 116.

Preparation of Toner 26

Spherical encapsulated toner K' was prepared at same compositions and by same method as the preparation of toner A' except that in organic magnetic particle EPT-100 (( ); made by Toda Kogyo K.K.) was used instead of the polymeric magnetic coordination complex.

The mean particle size of the spherical encapsulated toner K' was 13 μm.

SF1 of toner K' was 110, and SF2 was 121.

EXAMPLE 21

The toner obtained in the preparation of toner A' and the carrier obtained in the preparation of carrier 1 were combined to give a developer (mixing ratio of toner : 10 wt%).

The charge and dusting of the toner after the developer was mixed for 3, 10 or 30 minutes were measured.

The charge was −11.2, −11.3 or −11.3 μC/g, and dusting was 21,20,19 cpm, respectively. The results show that charge was instantly and stable built up.

The charge and dusting of the toner after storing this developer at 35° C. at high humidity of 85% RH for 24 hours were −11.0 μC/g and 20 cpm, respectively. This result indicates that this toner is excellent in resistance to environment.

The build-up of charge of the toner was examined by putting surface-treated (post-treated with 0.1 parts by weight of colloidal silica (made by Nihon Aerosol K.K.) based on 100 parts by weight of toner) (3 g) and microcarrier (27 g) in 50 cc plastic bottle which was placed on a rotating frame, rotating the frame at 1,200 rpm, and measuring the charge after stirring for 3, 10 and 30 minutes.

The dustability was measured using a digital dust measuring apparatus type P5H2 (made by Shibata Kagaku K.K.). The above dust measuring apparatus was placed 10 cm away from the magnet roller, and the developer (2 g) was set on the magnet roller. The toner particles produced when the magnet roller was rotated at 2,000 rpm was measured as dust by the above dust measuring apparatus and indicated as count per minute (cpm).

Subsequently, using the above developer and a copy machine equipped with positive-chargeable Se sensitive member and Teflon-coated heat-fixing roller, positive electrostatic image was developed by magnetic brush development and 60,000 copies were continuously produced. At the beginning, high definition image excellent in picture quality with uniform density and absolutely free form fog or dusting of toner was obtained. Such high quality was maintained after 60,000 copies were produced. According to the examination of carrier in the developer, the spent of toner was not observed. Further, according to the examination on the photosensitive member, filming was not generated.

The results are shown in Table 4.

In Table 4, general evaluation of the image was indicated using marks; ⊙, ○, Δ or x, in which, ⊙: with proper image density, good fine-line duplicability, free from fog, with gradation duplicability of more than 10.

: with proper image density, lacking stability of fine-line duplicability, free from fog, with gradation duplicability of more than 8.

Δ: lacking stability of image density, inferior in fine-line duplicability, frequently producing fog, with gradation duplicability of less than 6.

x : with greatly varying image density, deficient in fine-line duplicability, generating fog, with gradation duplicability of less than 4.

As for the initial image in Table 4, the picture quality obtained at the beginning of plate wear test was evaluated, wherein the term "good" means that image of high quality having uniform density and was free from fog and dusting of toner and the like.

The picture quality after plate wear test was evaluated. The term "stable" means that image density after printing 60,000 copies was same as that of the initial image.

Fixing properties was evaluated by rubbing the initial image with an eraser and indicated using marks in which : disorder in images were not observed even after more than 20 times erasing.

: disorder in images were not observed even after 15–20 times erasing.

Δ: disorder in images were not observed even after 10–15 times erasing.

x : disorder in images were observed only after less than 10 times erasing.

EXAMPLES 22–25

A developer was prepared and toner was evaluated similarly as Example 21 except that toner B' was usued and an organic photosensitive member of laminated type was used as a photosensitive memver.

The results were shown in Table 4.

EXAMPLE 26

The evaluation of toner was carried out similarly as Example 21 except that toner E' was used.

The results were shown in Table 4.

EXAMPLE 27

The evaluation of toner was carried out similarly as Example 22 except that toner G' was used.

The results were shown in Table 4.

EXAMPLE 28

The evaluation of toner was carried out similarly as Example 22 except that toner I' was used.

The results were shown in Table 4.

Comparative Example 11

In the same manner as that of Example 21, the developer with a mixing ratio of toner of 10 wt% was obtained.

The charge and dusting of the toner after the developer was mixed for 3, 10, 30 minutes was −13.0, −13.2, −13.2 μC/g; 346, 340, 337 cpm, respectively.

Compared with the data of Example 21, the dusting of the toner of this reference example was greater, resulting in providing problems such as fog of the image and contamination of the inside of a copying machine.

Using this developer, plate wear test was conducted under the same conditions as those of Example 21. As the result, the charge of toner was unstable and fog of the image was generated even at the beginning.

The results were shown in Table 4.

COMPARATIVE EXAMPLES 12–16

The evaluations of toners were carried out similarly as Example 21 or Example 22 except that toners shown in Table 4 were used.

The results were shown in Table 4.

TABLE 4

| | Toner | | | 3 min. | | 10 min. | | 30 min. | | After Humidity Resistant Test | | | | | | | |
|---|---|---|---|---|---|---|---|---|---|---|---|---|---|---|---|---|---|
| | | SF1 | SF2 | toner charge (ηC/g) | dusting charge (cpm) | toner charge (ηC/g) | dusting charge (cpm) | toner charge (ηC/g) | dusting charge (cpm) | toner charge (ηC/g) | dusting charge (cpm) | *1 | *2 | *3 | *4 | *5 | *6 |
| EXAMPLE | | | | | | | | | | | | | | | | | |
| 21 | A' | 121 | 137 | −11.5 | 21 | −11.6 | 20 | −11.6 | 19 | −11.5 | 20 | ⊙ | 60000 | good | stable | no | ⊙ |
| 22 | B' | 122 | 135 | +12.0 | 18 | +12.2 | 17 | +12.3 | 18 | +12.1 | 18 | ⊙ | 60000 | good | stable | no | ⊙ |
| 23 | E' | 107 | 113 | −10.8 | 23 | −10.7 | 24 | −10.8 | 22 | −10.7 | 22 | ⊙ | 60000 | good | stable | no | ⊙ |
| 24 | G' | 111 | 119 | +11.8 | 20 | −11.9 | 19 | +11.8 | 20 | +11.8 | 21 | ⊙ | 60000 | good | stable | no | ⊙ |
| 25 | I' | 106 | 114 | +11.9 | 19 | +12.1 | 20 | +12.0 | 19 | +12.0 | 20 | ⊙ | 60000 | good | sta- | no | ⊙ |

TABLE 4-continued

| | Toner | SF1 | SF2 | 3 min. toner charge (ηC/g) | 3 min. dusting charge (cpm) | 10 min. toner charge (ηC/g) | 10 min. dusting charge (cpm) | 30 min. toner charge (ηC/g) | 30 min. dusting charge (cpm) | After Humidity Resistant Test toner charge (ηC/g) | After Humidity Resistant Test dusting charge (cpm) | *1 | *2 | *3 | *4 | *5 | *6 |
|---|---|---|---|---|---|---|---|---|---|---|---|---|---|---|---|---|---|
| COMPARATIVE EXAMPLE | | | | | | | | | | | | | | | | | |
| 26 | C' | 124 | 137 | −13.0 | 346 | −13.2 | 340 | −13.2 | 337 | −12.9 | 352 | Δ | — | fog | *a | ble observed | ◎ |
| 27 | D' | 123 | 135 | +13.2 | 331 | +13.4 | 327 | +13.3 | 324 | +13.0 | 347 | Δ | — | fog | *a | observed | ◎ |
| 28 | F' | 108 | 117 | −12.1 | 397 | −12.0 | 391 | −12.2 | 398 | −11.9 | 407 | X | — | *a | *a | observed | ◎ |
| 29 | H' | 110 | 120 | +12.8 | 427 | +12.9 | 423 | +13.0 | 428 | +12.6 | 438 | X | — | *a | *a | observed | ◎ |
| 30 | J' | 106 | 116 | +13.1 | 388 | +13.2 | 383 | +13.4 | 329 | +12.9 | 407 | Δ | — | fog | *a | observed | ◎ |
| 31 | K' | 110 | 121 | −10.2 | 31 | −10.3 | 30 | −10.3 | 31 | −7.8 | 47 | X | 60000 | *b | *c | observed | X |

*1: General Evaluation
*2: Plate Wear Test (sheets)
*3: Initial Image
*4: Image Quality
*5: Fog
*6: Fixing Properties
*a: many fogs
*b: a little fogs
*c: fogs increased

What is claimed is:

1. A toner for electrophotography comprising a resin, a colorant and a polymeric-magnetic coordination complex.

2. A toner for electrophotography comprising a resin, a colorant and a polymeric-magnetic coordination complex; the polymeric-magnetic coordination complex powder is contained in and/or on the surface part of the toner.

3. A spherical toner for electrophotography comprising a resin, a colorant and polymeric-magnetic coordination complex.

4. A spherical toner of claim 3, wherein SF1 is within the range of between 100 and 130, and SF2 is within the range of between 100 and 140.

5. A color toner for electrophotography comprising a resin, a colorant and polymeric-magnetic coordination complex.

6. A toner of claim 1, wherein the polymeric-magnetic coordination complex is PPH-$FeSO_4$.

7. A toner of claim 2, wherein the polymeric-magnetic coordination complex is PPH-$FeSO_4$.

8. A spherical toner of claim 3 or claim 4, wherein the polymeric-magnetic coordination complex is PPH-$FeS_4$.

9. A color toner of claim 5, wherein the polymeric-magnetic coordination complex is PPH-$FeSO_4$.

* * * * *